US006477810B2

(12) United States Patent
Van De Keuken

(10) Patent No.: US 6,477,810 B2
(45) Date of Patent: Nov. 12, 2002

(54) CLOSING MECHANISM

(75) Inventor: Jan Van De Keuken, Almelo (NL)

(73) Assignee: Eno B.V. (NL)

( * ) Notice: Subject to any disclaimer, the term of this patent is extended or adjusted under 35 U.S.C. 154(b) by 42 days.

(21) Appl. No.: 09/810,327

(22) Filed: Mar. 16, 2001

(65) Prior Publication Data

US 2002/0129556 A1 Sep. 19, 2002

(51) Int. Cl.[7] ..... E05C 9/00

(52) U.S. Cl. ..... 49/395; 114/117; 292/33; 292/36

(58) Field of Search ..... 49/395, 394; 292/33, 292/35, 36, 41, 341.15; 114/116, 117

(56) References Cited

U.S. PATENT DOCUMENTS 2,271,952 A * 2/1942 Faus ..... 49/395
2,295,324 A * 9/1942 Arthur ..... 49/395
5,086,587 A * 2/1992 Andrews ..... 49/395
5,848,575 A * 12/1998 Freeman et al. ..... 114/117
6,101,764 A * 8/2000 Guy-Paul ..... 49/395
6,123,370 A * 9/2000 Rozema et al. ..... 292/47

* cited by examiner

*Primary Examiner*—Jerry Redman
(74) *Attorney, Agent, or Firm*—Webb Ziesenheim Logsdon Orkin & Hanson, P.C.

(57) ABSTRACT

The invention relates to a closing mechanism for a ship's door comprising:

a number of latches arranged around said door;

a substantially planar rod mechanism connected to said latches and comprising a number of guided rods;

an operating member connected to said rod mechanism for operating said latches via said planar rod mechanism;

wherein at least one of said rods is curved and guided between at least two rollers.

6 Claims, 2 Drawing Sheets

CLOSING MECHANISM

BACKGROUND OF THE INVENTION

1) Field of the Invention

The invention relates to a closing mechanism for a ship's door.

Currently, the closing mechanism of a ship's door has a number of laches arranged around the door and these latches are each connected to a rod system. An operating member, such as a lever or a turning wheel, is also connected to this rod system, in order to operate each latch simultaneously by operating the operating member.

2) Description of the Prior Art

This rod system is in most cases rectangular, and has at least one rod arranged on each side of the door.

To connect a vertical oriented rod with a horizontally oriented rod, a connection rod is arranged at the corner of these two rods. This connection rod is curved and has a shape similar to a banana. This curved connection rod is guided in a curved guide path, to enable it to transform a vertical ma:ion into a horizontal motion and vice versa.

Current doors, with such a curved, banana-shaped connection rod have a guide plate with a slot with a corresponding banana-shaped shape.

This construction of a banana-shape connection rod in a banana-shaped slot has several disadvantages.

Such a prior art connection rod needs frequent lubrication. The connection rod and the material in which the slot has been arranged are generally made of a metal, such as brass. Without lubrication, the rubbing of the connection rod in the slot will provide severe wear.

Another disadvantage is that grains, such as sand grains, could get stuck between the connection rod and a side of the slot. This will prevent good functioning of the guide rod and even result in jamming of the connection rod, and thus in jamming of the complete closing mechanism.

It is an object of the invention to improve the above mentioned closing mechanism.

SUMMARY OF THE INVENTION

This object is achieved by a closing mechanism according to the invention, which comprises:

a number of latches arranged around said door;

a substantially planar rod mechanism connected to said latches and comprising a number of guided rods;

an operating member connected to said rod mechanism for operating said latches via said planar rod mechanism;

wherein at least one of said rods is curved and guided by at least two rollers.

By guiding the curved rod by rollers, wear as a result of friction between contact surfaces of both the rod and the rollers is minimized. Furthermore, grains which fall into the pinch between a roller and the surface of the curved rod will by shifting of the curved rod roll under the roller and quickly be removed from this pinch, such that the grains are not able to jam the mechanism.

In a preferred embodiment of the closing mechanism according to the invention, said at least two rollers comprise a plastic bushing. This bushing is preferably of Arlon. The rollers could also be provided with a plastic lining. This provides for a maintenance free bearing of the rollers.

In another preferred embodiment of the closing mechanism according to the invention, said at least one curved rod has a brass contact surface and said at least two rollers have each a steel peripheral contact surface. When a grain is stuck between the pinch between the curved rod and a roller, this grain will be pressed in the relatively soft brass contact surface of the curved rod.

Just two rollers can be used as the curved rod is arranged between two adjacent rods of the rod mechanism. These rollers have to be arranged on the outside of the curved guide path. A third or more roller can be arranged on the inside for a more reliable functioning The invention also relates to a rod guide for a rod mechanism of a closing mechanism for a ship's door, said rod guide comprising:

a base;

at least three rollers rotatably arranged on said base and having their rotation axis extending perpendicular to said base;

a cover plate arranged parallel to said base;

wherein the periphery of at least two of said at least three rollers abut to one side of a curved guide path for guiding a rod and the periphery of at least one of said at least three rollers abuts on the other side of said curved guide path.

Finally, the invention relates to a closing mechanism for a ship's door comprising:

a number of latches arranged around said door;

a substantially planar rod mechanism connected to said latches and comprising a number of guided rods;

an operating member connected to said rod mechanism for operating said latches via said planar rod mechanism;

wherein at least one of said rods is curved and guided by a rod guide comprising:

a base;

at least three rollers rotatably arranged on said base and having their rotation axis extending perpendicular to said base;

a cover plate arranged parallel to said base; wherein the periphery of at least two of said at least three rollers abut to one side of a curved guide path for guiding a rod and the periphery of at least one of said at least three rollers abuts on the other side of said curved guide path.

BRIEF DESCRIPTION OF THE DRAWINGS

These and other advantages and features of the invention will be further described in conjunction with the accompanying drawings.

DETAILED DESCRIPTION OF THE PREFERRED EMBODIMENTS

Figure 1:
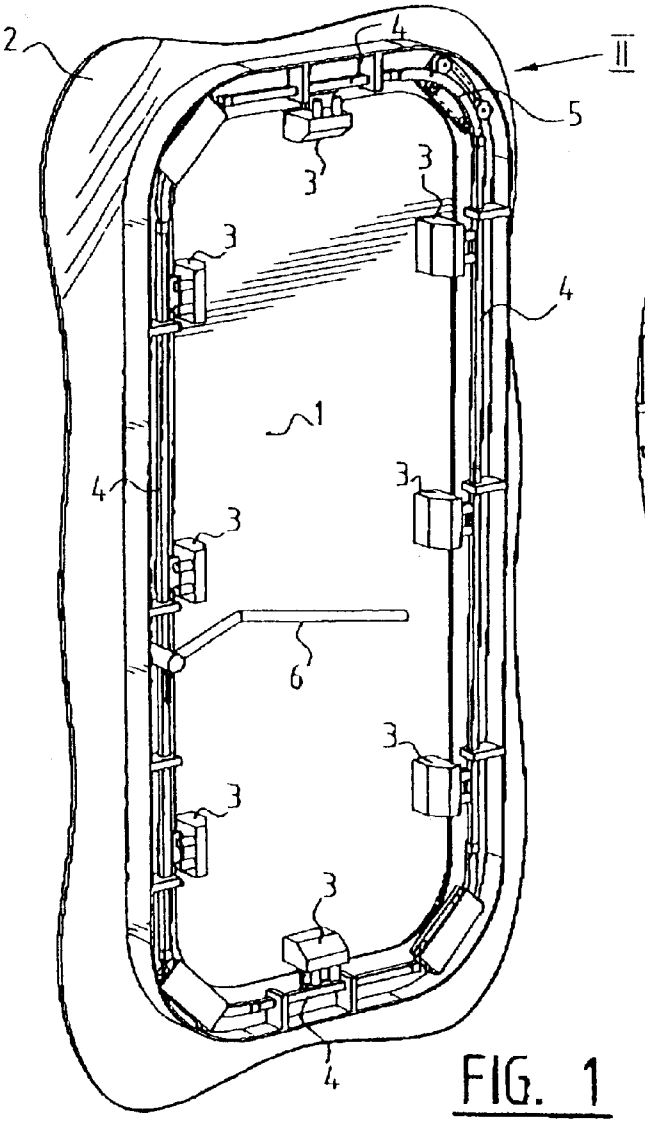
FIG. 1 shows a perspective view of a ship's door with a closing mechanism according to the invention.

FIG. 1 showy a door 1 with a closing mechanism according to the invention. This door 1 is arranged in the ship's hull 2. At the periphery of the door 1 a number of latches 3 is arranged. The construction of these latches 3 is irrelevant for the closing mechanism, and the embodiment of the latches 3 in the drawings is merely for explanatory purposes.

A planner rod system, with rods 4, 5 is arranged around the door 1.

This rod system 4, 5 can be operated by an operating lever 6. This operating lever 6 is far example connected to one of the rods 4 of the rod mechanism, by a pinion-rack construction. Other constructions are of course possible.

Figure 2:
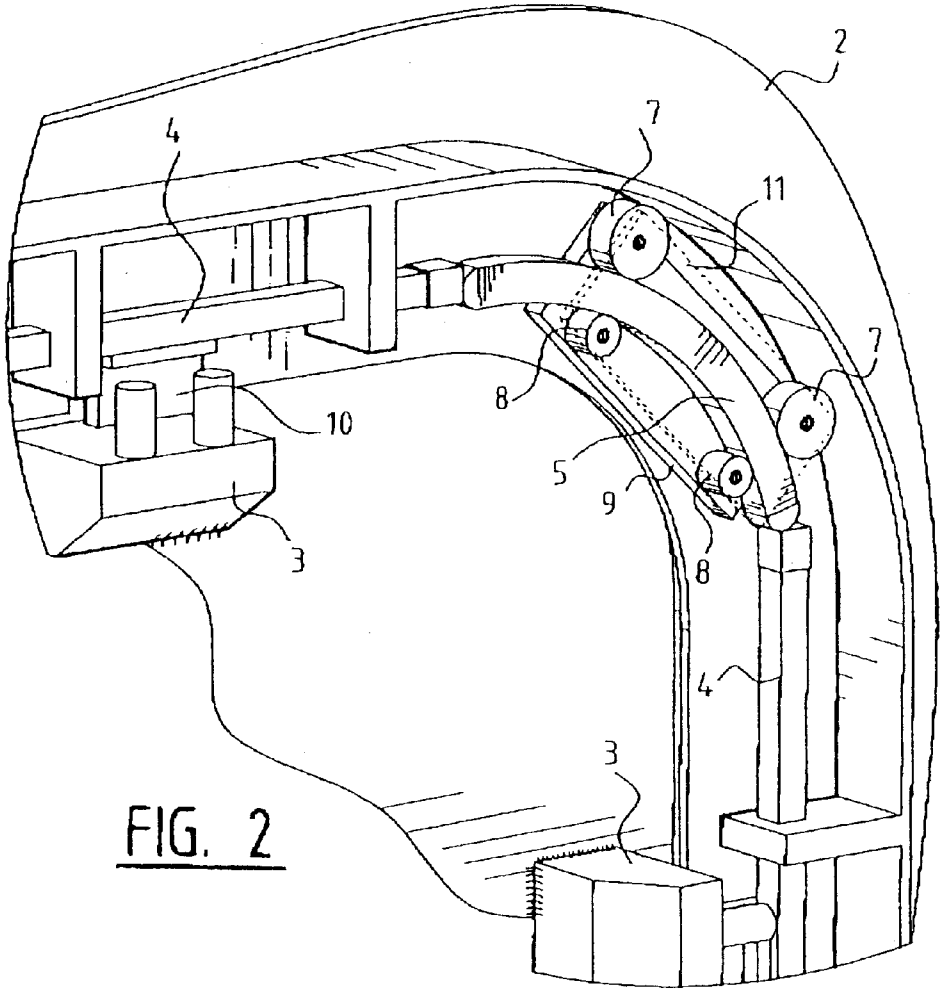
FIG. 2 shows an enlarged perspective view of a detail of the door of FIG. 1.

Now referring to FIG. 2, a detail of the corner construction of the rod mechanism 4, 5 is shown. A vertical and horizontal rod 4 of the rod system are connected by a banana-shaped rod 5. The protrusions 10 of each latch 3 are arranged, on the rods 4, which provide the locking action of the latches 3.

The banana-shaped rod 5 is guided by four rollers 7, 8. Each of the rollers 7, a is rotatably arranged on a base 9. The rotation axis of the rollers 7, 8 extend perpendicular from this base 9. The rollers 7, 8 are arranged such, that they provide a curved guide path, trough which the banana-shaped rod 5 is guided. A second cover plate 11 is arranged or toy of the rollers 7, 8 and parallel to the base 9, which prevents the rod 5 of getting out of the guide path.

Figure 3:
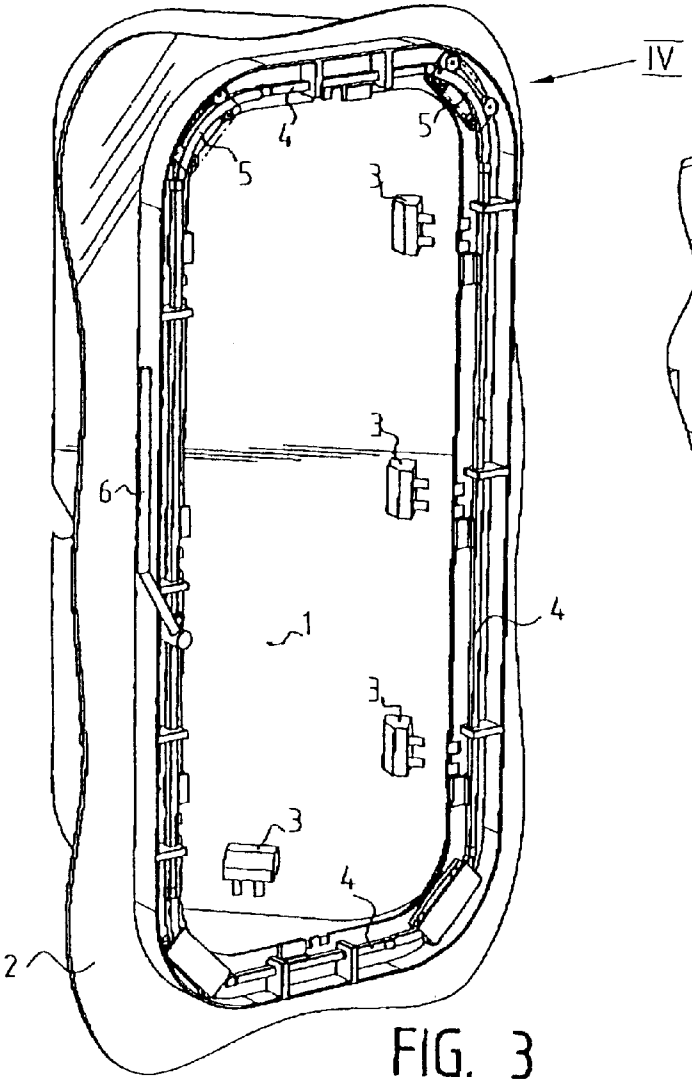
FIG. 3 shows a perspective view the door of FIG. 1 in an opened state.

In FIG. 3, the door 1 in open position is shown. The lever 6 is rotated upwardly, such that the rod mechanism 4, 5 was shifted in clockwise direction. Through this shift, the locking protrusions were shifted out of the reach of the latches 3, such that the door 1 could be opened.

Figure 4:
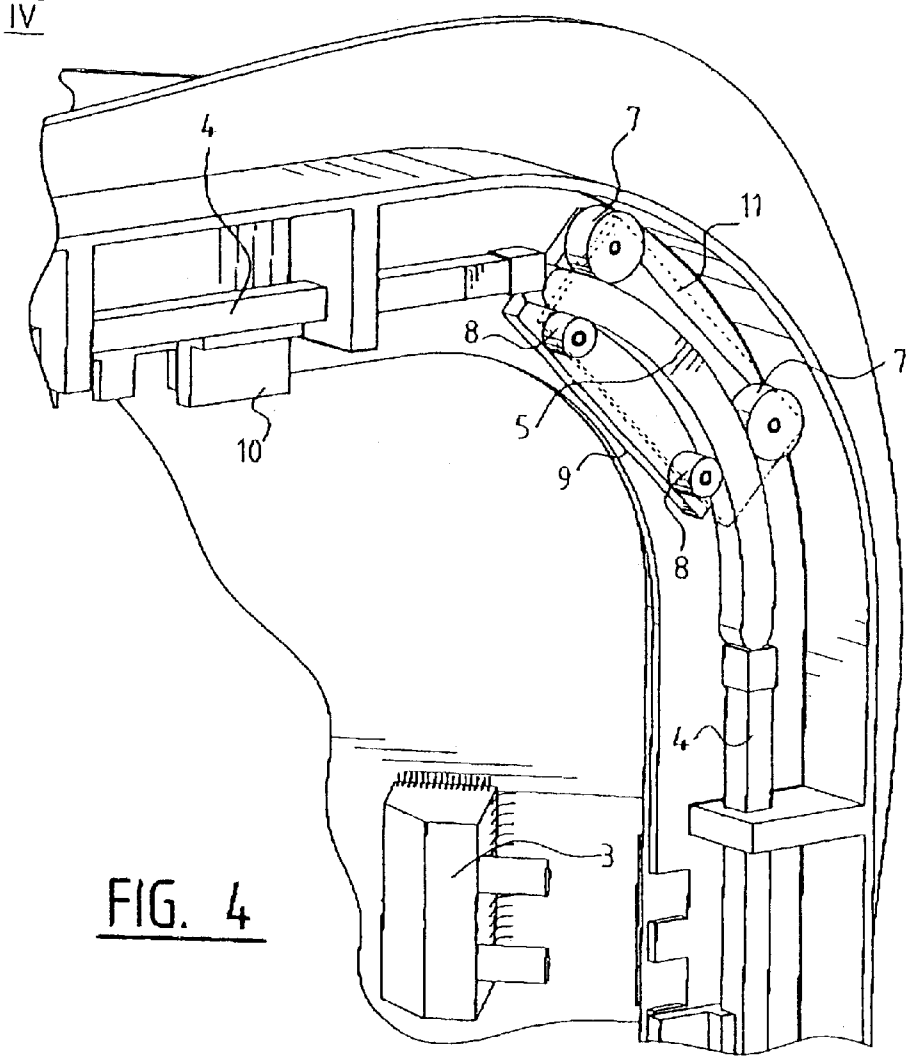
FIG. 4 shows an enlarged perspective view of a detail of FIG. 3.

The rod 5 (see FIG. 4) was also shifted by the action of the operating lever 6. The upper horizontal rod 4 pushed the banana-shaped rod 5 through the guide path provided by the rollers 7, a, in order to push the vertical rod 4. This construction is used at every corner of the door.

What is claimed is:

1. A closing mechanism for a ship's door comprising:

a number of latches arranged around said door;

a substantially planar rod mechanism connected to said latches and comprising a number of guided rods; and an operating member connected to said rod mechanism for operating said latches via said planar rod mechanisms, wherein at least one of said rods is curved and guided between at least two rollers.

2. The closing mechanism according to claim 1, wherein said at least two rollers comprise a plastic bushing.

3. The closing mechanism according to claim 2, wherein said bushing consists of Arlon.

4. The closing mechanism according to claim 1, wherein said at least one curved rod has a brass contact surface and wherein said at least two rollers each have a steel peripheral contact surface.

5. A rod guide for a rod mechanism of a closing mechanism for a ship's door, said rod guide comprising:

a base;

at least three rollers rotatably arranged on said base and having their rotation axis extending perpendicular to said base; and a cover plate arranged parallel to said base, wherein the periphery of at least two of said at least three rollers abut to one side of a curved rod having a curved guide path and the periphery of at least one of said at least three rollers abuts on the other side of said curved rod.

6. A closing mechanism for a ship's door comprising:

a number of latches arranged around said door;

a substantially planar rod mechanism connected to said latches and comprising a number of guided rods; and an operating member connected to said rod mechanism for operating said latches via said planar rod mechanism, wherein at least one of said rods is curved and guided by a rod guide comprising:

a base;

at least three rollers rotatably arranged on said base and having their rotation axis extending perpendicular to said base; and a cover plate arranged parallel to said base, wherein the periphery of at least two of said at least three rollers abut to one side of a curved rod having a curved guide path; and the periphery of at least one of said at least three rollers abuts on the other side of said curved rad.

* * * * *

UNITED STATES PATENT AND TRADEMARK OFFICE

CERTIFICATE OF CORRECTION

PATENT NO. : 6,477,810 B2
DATED : November 12, 2002
INVENTOR(S) : Jan Van de Keuken It is certified that error appears in the above-identified patent and that said Letters Patent is hereby corrected as shown below:

Column 1,
Between lines 7 and 8, insert the heading -- 2. Description of the Prior Art --.
Line 14, delete the heading "2. Description of the Prior Art".
Line 23, "vertical ma:ion" should read -- vertical motion --.

Column 3,
Line 2, "far example" should read -- for example --.
Line 12, "rollers 7, a is" should read -- rollers 7, 8 is --.
Line 15, "trough which" should read -- through which --.
Line 17, "or toy of" should read -- on top of --.
Line 28, "rollers 7, a" should read -- rollers 7, 8 --.
Line 37, "mechanisms," should read -- mechanism, --.

Column 4,
Line 37, "path; and" should read -- path and --.
Line 38, "curved rad." should read -- curved rod. --.

Signed and Sealed this

Twenty-fifth Day of March, 2003

JAMES E. ROGAN
*Director of the United States Patent and Trademark Office*